US008610633B2

(12) United States Patent
Chen et al.

(10) Patent No.: US 8,610,633 B2
(45) Date of Patent: Dec. 17, 2013

(54) DUAL POLARIZED WAVEGUIDE SLOT ARRAY AND ANTENNA

(75) Inventors: Ming H. Chen, Rancho Palos Verdes, CA (US); Di-Shang Hsu, Wujie Township (TW)

(73) Assignee: Victory Microwave Corporation (TW)

( * ) Notice: Subject to any disclaimer, the term of this patent is extended or adjusted under 35 U.S.C. 154(b) by 244 days.

(21) Appl. No.: 13/163,936

(22) Filed: Jun. 20, 2011

(65) Prior Publication Data

US 2012/0038530 A1 Feb. 16, 2012

Related U.S. Application Data

(60) Provisional application No. 61/372,214, filed on Aug. 10, 2010.

(51) Int. Cl.
*H01Q 13/10* (2006.01)

(52) U.S. Cl.
USPC ..... 343/771; 343/767; 343/770; 343/772

(58) Field of Classification Search
USPC ..... 343/770, 771, 767, 772, 762
See application file for complete search history.

(56) References Cited

U.S. PATENT DOCUMENTS 2,772,400 A * 11/1956 Simmons ..... 333/21 R
5,914,694 A * 6/1999 Raab ..... 343/771
7,327,325 B2 2/2008 Schadler

* cited by examiner

*Primary Examiner* — Dieu H Duong
(74) *Attorney, Agent, or Firm* — Clifford Perry

(57) ABSTRACT

A dual polarized waveguide slot array includes a first waveguide and a second waveguide. The first waveguide includes major and minor cross-sectional axes and extends along a common longitudinal axis. The first waveguide further includes a plurality of slots disposed thereon for radiating or receiving signals of a first polarization. The second waveguide is coupled to the first waveguide, extending along the common longitudinal axis and having major and minor cross-sectional axes. The major cross-sectional axis of the second waveguide oriented substantially orthogonally to the cross-sectional axis of the first waveguide, and the second waveguide includes a plurality of slots disposed thereon for radiating or receiving signals of a second polarization substantially orthogonal to the first polarization.

26 Claims, 14 Drawing Sheets

DUAL POLARIZED WAVEGUIDE SLOT ARRAY AND ANTENNA

CROSS-REFERENCE TO RELATED APPLICATIONS

This application claims the benefit of priority of U.S. provisional application 61/372,214 entitled "Dual Polarized Waveguide Slot Array," filed Aug. 10, 2010, the contents of which are herein incorporated by reference in its entirety for all purposes.

BACKGROUND

The present invention relates to waveguide antennae, and more particularly to dual polarized waveguide slot array antennae.

Waveguide slot array antennae are well known in the art, and are typically employed for providing high power capability in applications, such as base station transmitting antenna arrays.

FIG. 7A illustrates a conventional vertically-polarized waveguide slot array 700 as known in the art. The array 700 includes a waveguide slot body 710 which is operable to support the propagation of a signal along a longitudinal axis 712 (z-axis) of the waveguide slot body 710. Transverse to the longitudinal axis 712, the waveguide slot body 710 defines a waveguide aperture having a major dimension 713 (along the x-axis) and a minor dimension 714 (along the y-axis). The major dimension 713 defines the lowest frequency of operation for the array 700, and is typically 0.5λ in its dimension. The waveguide slot body 710 further includes edge slots 722 and 724, each angled a in respective positive and negative angular orientations relative to the axis of the minor dimension 714. An end cap 730 is located at the top of the array 700.

FIG. 7B illustrates typical radiation patterns 750 for the vertically-polarized waveguide slot array 700 of FIG. 7A. The patterns 750 include an azimuth radiation pattern 752 and an elevation pattern 754. The azimuth radiation pattern 752 exhibits 8 dB variation, as shown.

FIG. 8A illustrates a conventional horizontally-polarized waveguide slot array 800 with horizontal polarization as known in the art. The array 800 includes a waveguide slot body 810 which is operable to support the propagation of a signal along a longitudinal axis 812 (z-axis) of the waveguide slot body 810. Transverse to the longitudinal axis 812, the waveguide slot body 810 defines a waveguide aperture having a major dimension 813 (along the x-axis) and a minor dimension 814 (along the y-axis). The major dimension 813 defines the lowest frequency of operation for the array 800, and is typically 0.5λ in its dimension. The waveguide slot body 810 further includes longitudinal slots 820, each slot offset a predefined distance from a center line defining the major axis 812 of the waveguide body 810, adjacent slots offset in opposing directions from the center line. An end cap 830 is located at the top of the array 800.

FIG. 8B illustrates typical radiation patterns 850 for the horizontally-polarized waveguide slot array 800 of FIG. 8A. The patterns 850 include an azimuth radiation pattern 852 and an elevation pattern 854. The azimuth radiation pattern 852 exhibits 4 dB variation, as shown.

As can be observed, the azimuth radiation patterns for each of the conventional vertically and horizontally-polarized waveguide slot arrays vary significantly over the coverage area, meaning that signal levels over these coverage areas vary greatly as a function of the user's position. As a result, a high power transmitter or a high gain antenna is needed to ensure that the minimum signal level is provided to all users, independent of their location. Accordingly, although slot arrays are suitable for high power transmission and reception applications, they cannot be fully deployed in applications where more uniform coverage is needed.

What is accordingly needed is a waveguide slot array which can provide a more uniform radiation pattern.

SUMMARY

The present invention provides an improved dual polarized waveguide slot array which includes a first waveguide and a second waveguide. The first waveguide includes major and minor cross-sectional axes and extends along a common longitudinal axis. The first waveguide further includes a plurality of slots disposed thereon for radiating or receiving signals of a first polarization. The second waveguide is coupled to the first waveguide, extending along the common longitudinal axis and having major and minor cross-sectional axes. The major cross-sectional axis of the second waveguide is oriented substantially orthogonally to the cross-sectional axis of the first waveguide, and the second waveguide includes a plurality of slots disposed thereon for radiating or receiving signals of a second polarization substantially orthogonal to the first polarization.

These and other features of the invention will be better understood in view of the following drawings and detailed description of exemplary embodiments.

For clarity, previously described features retain their reference indices in subsequent drawings.

DETAILED DESCRIPTION OF EXEMPLARY EMBODIMENTS

Figure 1A:
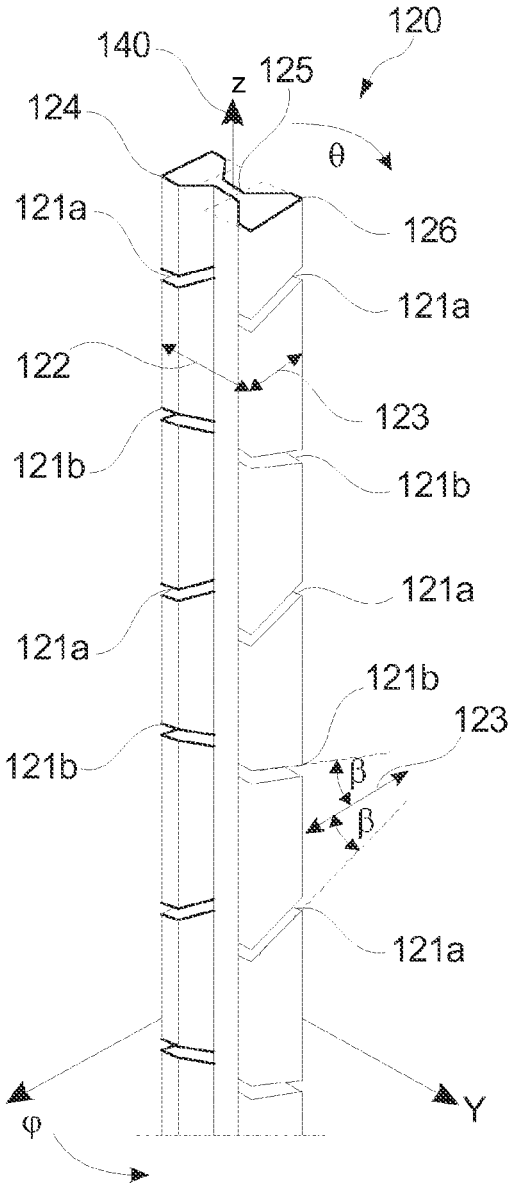
FIGS. 1A-1D illustrate perspective and cross-sectional views of a dual polarized waveguide slot array in accordance with the present invention.
Figure 1B:
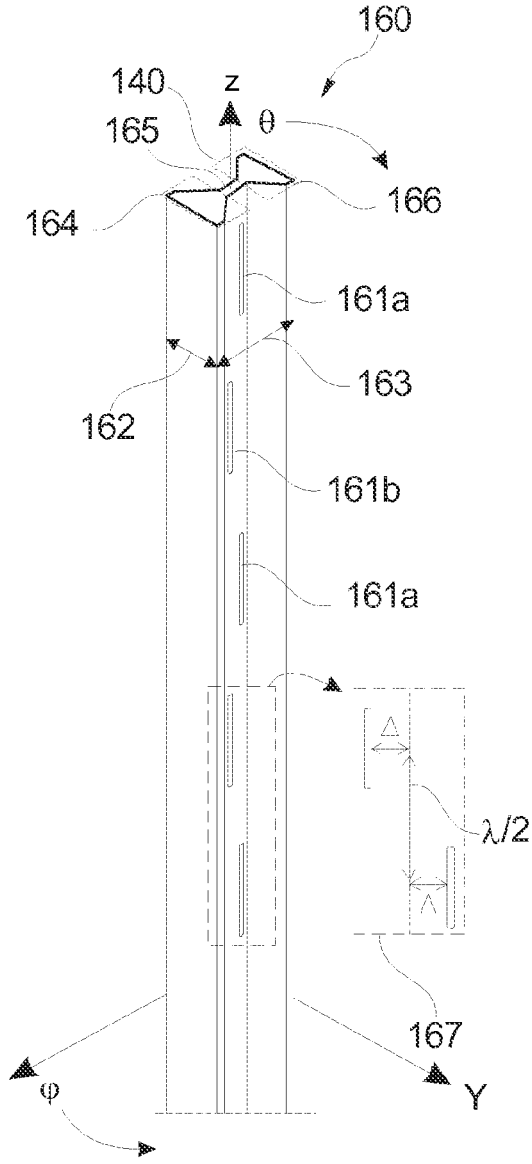
Figure 1C:
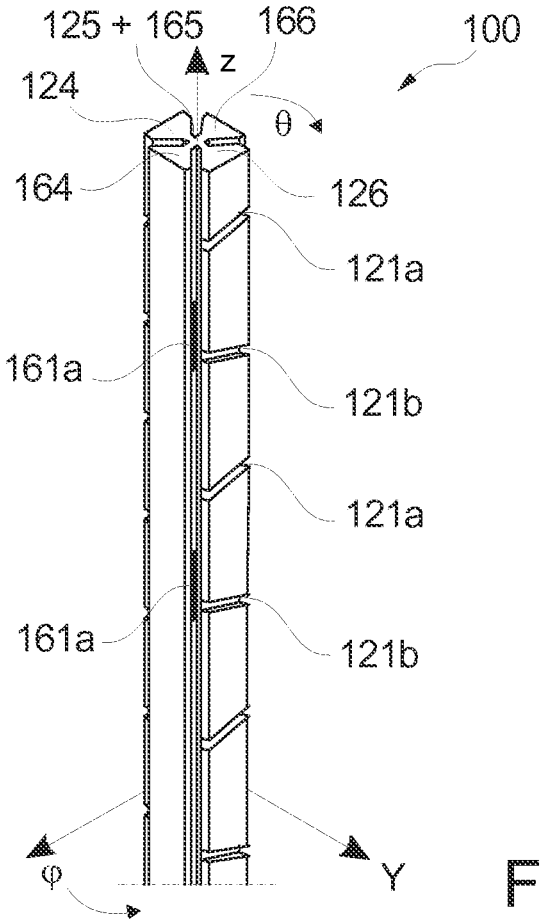
Figure 1D:
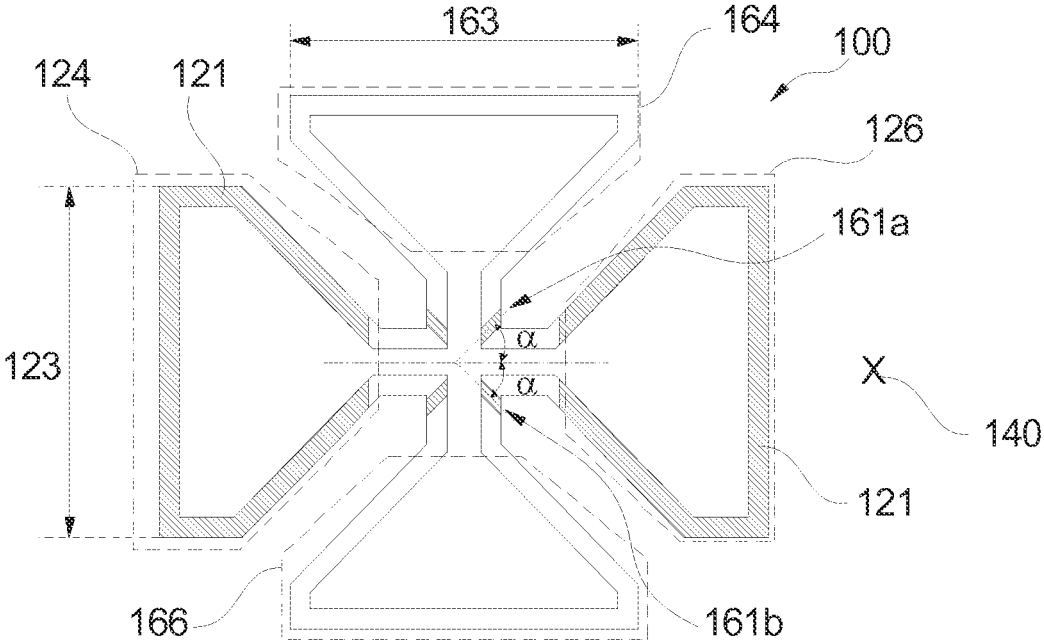

FIGS. 1A-1D illustrate perspective and cross-sectional views of a dual polarized waveguide slot array in accordance with the present invention. For clarity, each of the perspective views shown in FIGS. 1A and 1B illustrate one isolated portion of the integrated dual polarized waveguide slot array. The cross-sectional view shown in FIG. 1C and the perspective view of FIG. 1D shows the integrated array in accordance with the invention.

The array 100 includes a first waveguide 120 having major and minor cross-sectional axes 122, 123, and extending along a common longitudinal axis 140. The first waveguide 120 further includes a plurality of slots 121, herein referred to as edge slots disposed on the first waveguide 120 for radiating or receiving signals of a first polarization. As shown, the first and second waveguides 120 and 160 are integrally formed so as to form a single wall defining the periphery of the array 100.

The array 100 further includes a second waveguide 160 which is coupled to the first waveguide 120, as shown. The second waveguide section 160 extends along the common longitudinal axis 140 and includes major and minor cross-sectional axes 162, 163. Exemplary, the major cross-sectional axis 162 of the second waveguide 160 oriented substantially orthogonally to the cross-sectional axis 122 of the first waveguide 120. The second waveguide 160 includes a plurality of slots 161, herein referred to as "longitudinal slots", disposed on the second waveguide section 160 for radiating or receiving signals of a second polarization which is substantially orthogonal to the first polarization. In one exemplary embodiment, the signal polarization is linear, and accordingly, the first and second polarized signals are vertically- and horizontally-polarized signals. In another embodiment, the signal polarization is circular, and accordingly, the first and second polarized signals are right and left hand circularly polarized signals. Further exemplary, the signals of the first and second polarization operate substantially at the same radio frequency, exemplary in the range from 0.5-30 GHz, e.g., within any of the L, X, Ku, Ka frequency bands. In another embodiment, the first and second waveguides are sized to support the propagation of signals operating at different frequencies.

The first waveguide section 120 is operable to support the propagation of a first signal with the first polarization (e.g., a vertically-polarized radio frequency signal), and exemplary includes two outer waveguide sections 124, 126 which are laterally-opposed along the major cross-section axis 122, and an inner waveguide section 125 coupled between the two outer waveguide sections 124 and 126.

Further exemplary, one or more edge slots 121 (shown shaded gray in FIG. 1D) are disposed in each of the two outer waveguide sections 124, 126. As shown, the transition from the two outer waveguide sections 124, 126 to the inner waveguide section 125 in one embodiment is a linear taper, although other transition geometries may be used in alternative embodiments, for example, one or more steps, or a non-linear taper. Further exemplary of the first waveguide section 120, each of the edge slots 121 extend around a majority of the periphery of the two outer waveguide sections 124, 126 (shown as extending around 3 sides of each outer waveguide section 124, 126). Even more particularly, each outer waveguide section 124, 126 includes adjacent edge slots 121*a*, 121*b*, whereby the adjacent edge slots are complementary-angled $\pm\beta$ degrees relative to the minor cross-sectional axis of the first waveguide section. Exemplary, angle $\theta$ is an angle ranging from 10-35 degree, e.g., 23 degrees.

The second waveguide section 160 is operable to support the propagation of a second signal with the second polarization (e.g., a horizontal-polarized radio frequency signal), and exemplary includes two outer waveguide sections 164, 166 which are laterally-opposed along the major cross-section axis 162, and an inner waveguide section 165 coupled between the two outer waveguide sections 164 and 166. Further exemplary, a plurality of longitudinal slots 161 is disposed along the longitudinal axis of the inner waveguide section 165. As shown, the transition from the two outer waveguide sections 164, 166 to the inner waveguide section 165 in one embodiment is a linear taper, although other transition geometries may be used in alternative embodiments, for example, one or more steps, or a non-linear taper. Further exemplary, the inner waveguide sections 125 and 165 combine to form a four-way cross as shown in FIGS. 1C and 1D, and in this manner the first and second waveguides are joined together.

Further exemplary of the second waveguide section 160, the plurality of slots 161 includes adjacently located slots 161*a* and 161*b* which are oppositely offset predefined distances $\pm\Delta$ from a center line 167 of the major cross-sectional axis 162. Exemplary the distance ranges from $\lambda_g/20$–$\lambda_g/5$, and is exemplary $\lambda_g/10$, where $\lambda_g$ represents the guide wavelength of the signal operating within the second waveguide 160. Further exemplary, the adjacent slots 161*a* and 161*b* are offset longitudinally a predefined distance, e.g., $\lambda_g/2$ in separation.

Further exemplary, each of the edge slots 121 extend around a majority of the periphery of the two outer waveguide sections 124, 126. Even more particularly, each outer waveguide section 124, 126 includes adjacent edge slots 121*a*, 121*b*, whereby the adjacent edge slots are complementary-angled a predefined angle $\beta$ relative to the minor cross-sectional axis of the first waveguide section. Exemplary, angle $\beta$ is an angle ranging from 10-35 degree, e.g., 23 degrees.

Further exemplary of the second waveguide 160, the longitudinal slots 161 are disposed in the inner waveguide section 165 at predefined complementary angles $\pm\alpha$ relative to the minor cross-section axis 163 of the second waveguide 160. Exemplary, angle $\alpha$ ranges from 10-80 degrees, and exemplary is 45 degrees. As shown, the longitudinal slots 161 are disposed (exemplary mirrored in location and dimensions) on both broadsides of the inner waveguide section 165.

The array 100 is capped at one end (shown in FIGS. 1A-1C as the top or the upper most portion of the array 100) and extends along the opposing longitudinal end to additional waveguide structures/components, for example, to a ridge waveguide to square waveguide transformer and/or a square waveguide to coaxial input adapter, shown in FIGS. 6A-6C described below.

Exemplary, the array 100 is constructed from a material such as copper, brass, aluminum, Kovar, or other materials used in the field of waveguides. Further exemplary, the waveguides are sized to support the propagation of a desired signal, e.g., the major and minor cross-section dimensions of the first and second waveguides 120 and 160 are selected such that those waveguides operate above the cut-off frequency therefor. Various manufacturing techniques can be used to produce the array 100, for example numerically-controlled machining, casting, or other waveguide construction techniques.

Figure 2A:
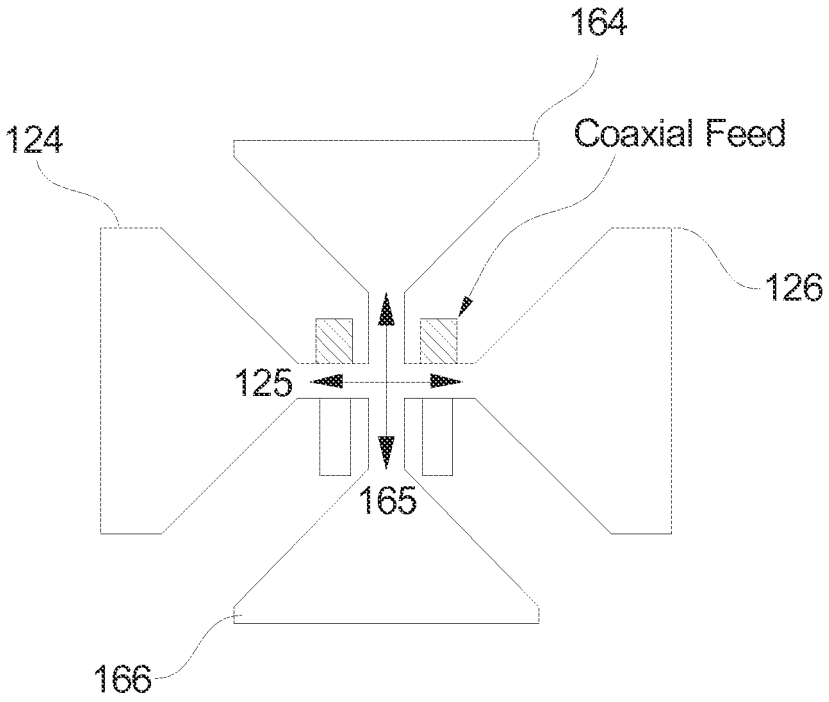
FIGS. 2A and 2B illustrate coaxial feeds for the dual polarized waveguide slot array shown in FIGS. 1A-1D in accordance with the invention.
Figure 2B:
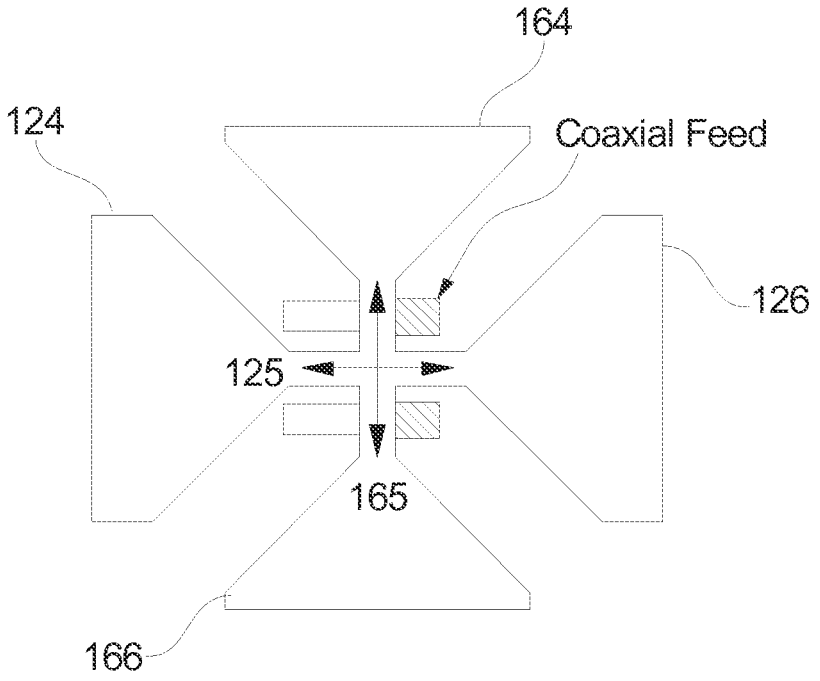

FIGS. 2A and 2B illustrate coaxial feeds for the dual polarized waveguide slot array in accordance with the invention. FIG. 2A illustrates placement of the coaxial feeds for the first waveguide section 120, and FIG. 2B illustrate placement of the coaxial feeds for the second waveguide section 160. Exemplary, a power divider can be used to supply in-phase power to each of the feeds for both of the embodiments shown in FIGS. 2A and 2B. Alternatively, the array 100 may be coupled to a transformer, and the feeds may be located in exemplary arrangements shown in FIGS. 6A-6C and 6F-6I below.

Figure 3A:
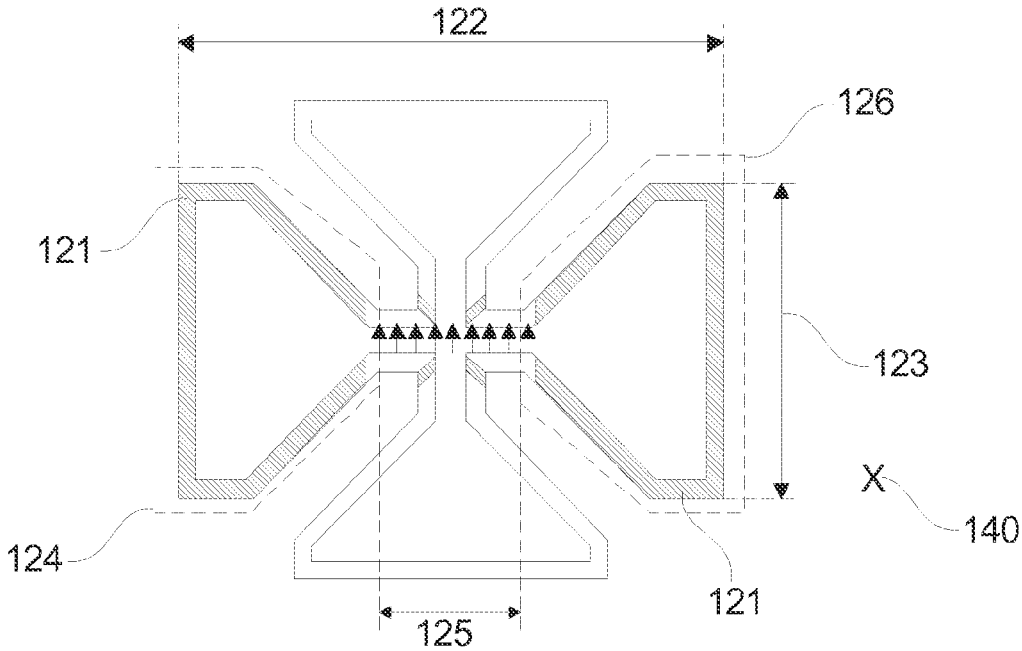
FIG. 3A illustrates the dual polarized waveguide slot array of FIGS. 1A-1D operating in a vertically-polarized mode in accordance with the present invention.

FIG. 3A illustrates the dual polarized waveguide slot array 100 operating in a first polarization mode, exemplary a vertically-polarized mode in accordance with the present invention. As shown, an electric field of the propagating signal extends vertically between the broadsides of the inner waveguide section 125 of the first (vertical) waveguide 120.

Figure 3B:
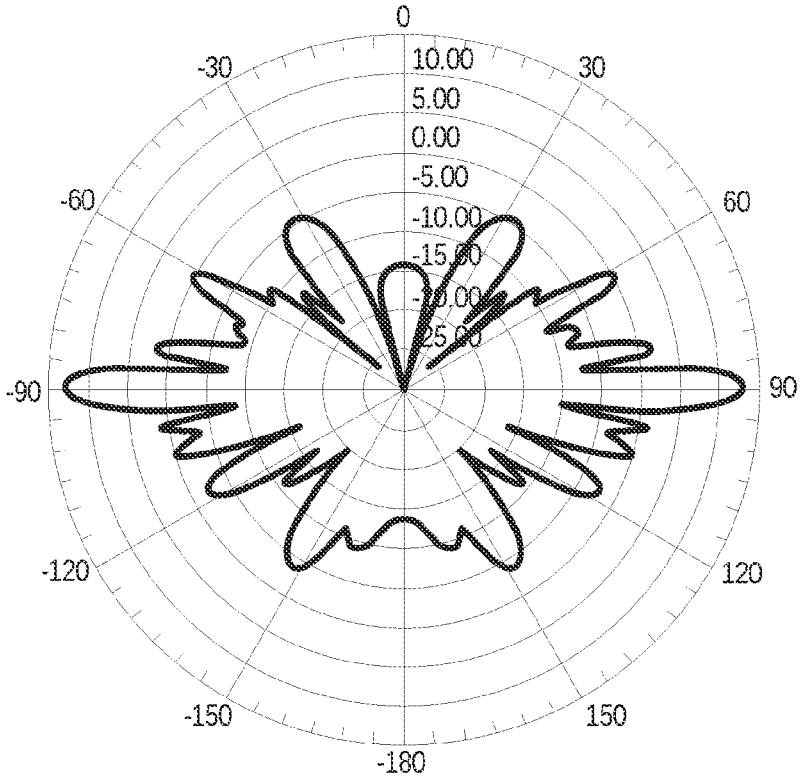
FIGS. 3B and 3C illustrate respective elevation and azimuth radiation patterns for the dual polarized waveguide slot array of FIG. 3A in accordance with the present invention.
Figure 3C:
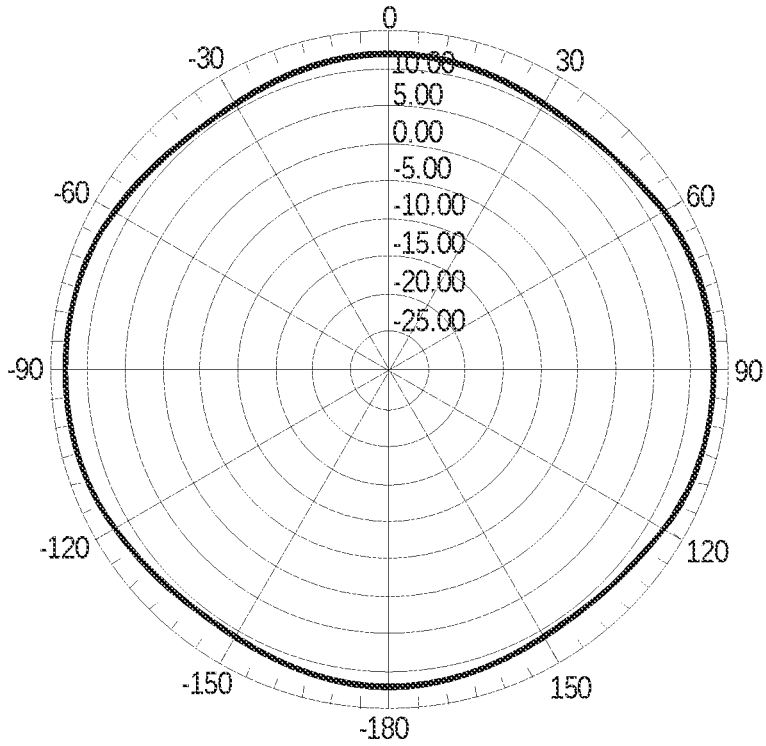

FIGS. 3B and 3C illustrate respective elevation ($\phi$=90 degrees) and azimuth ($\theta$=90 degrees) radiation patterns for the dual polarized waveguide slot array 100 when operating in the first/vertical polarization mode over the frequency range of 1.88-1.920 GHz.

Figure 4A:
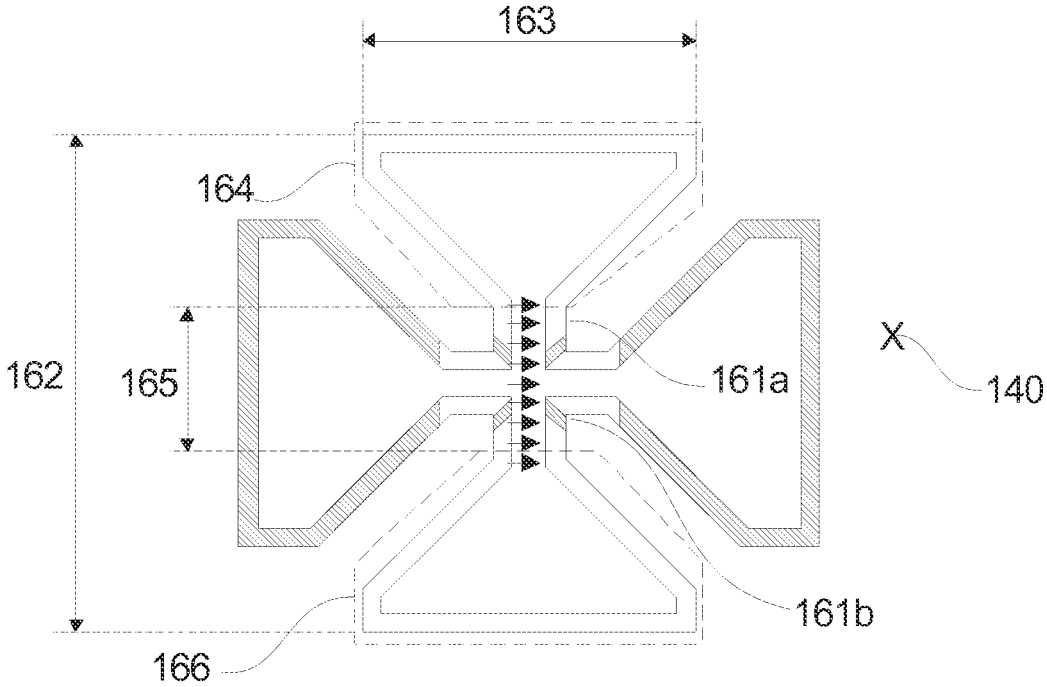
FIG. 4A illustrates the dual polarized waveguide slot array of FIGS. 1A-1D operating in a horizontally-polarized mode in accordance with the present invention.

FIG. 4A illustrates the dual polarized waveguide slot array 100 operating in a second polarization mode, exemplary a horizontally-polarized mode in accordance with the present invention. As shown, an electric field of the propagating signal extends horizontally between the broadsides of the inner waveguide section 165 of the second (horizontal) waveguide 160.

Figure 4B:
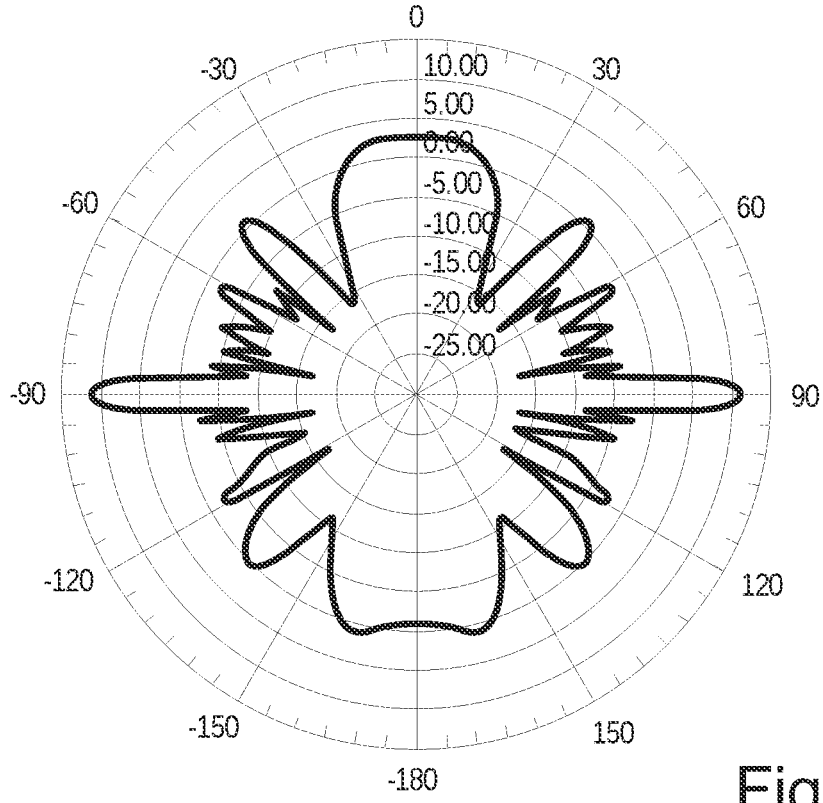
FIGS. 4B and 4C illustrate respective elevation and azimuth radiation patterns for the dual polarized waveguide slot array of FIG. 4A in accordance with the present invention.
Figure 4C:
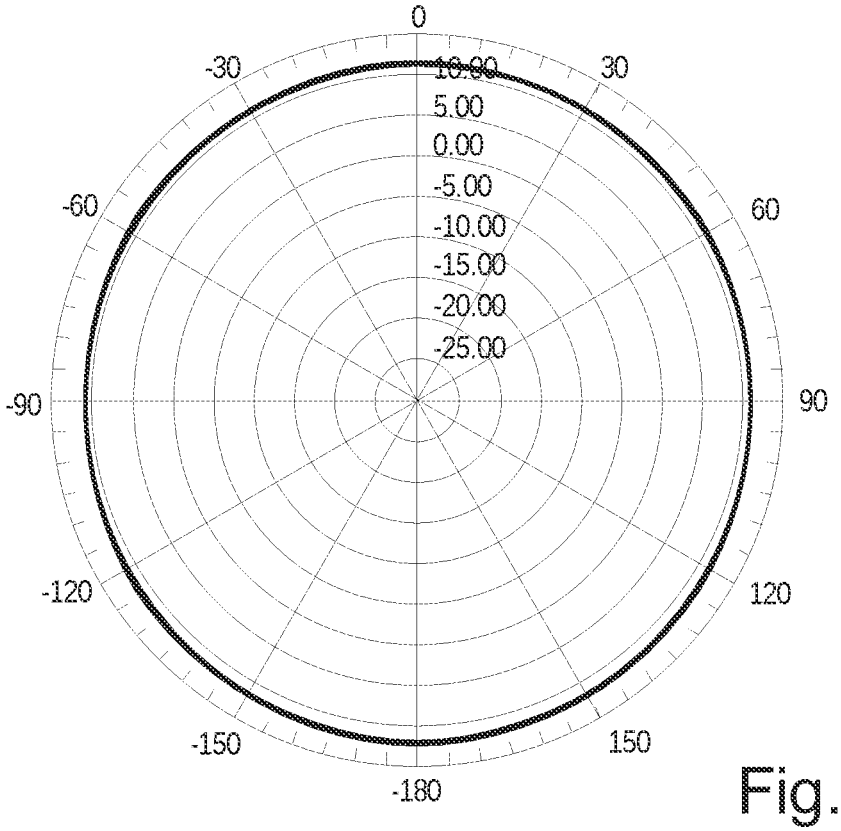

FIGS. 4B and 4C illustrate respective elevation ($\phi$=90 degrees) and azimuth ($\theta$=90 degrees) radiation patterns for the dual polarized waveguide slot array 100 when operating in the second/horizontal polarization mode over the frequency range of 1.88-1.920 GHz.

Figure 5A:
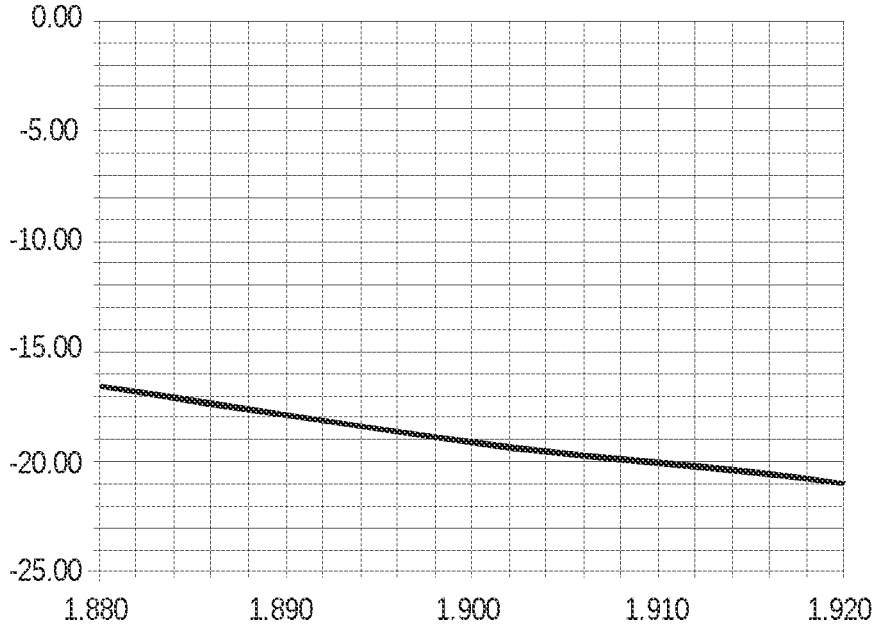
FIGS. 5A-5C illustrate return loss and isolation parameters for the dual polarized waveguide slot array of FIGS. 1A-1D in accordance with the present invention.
Figure 5B:
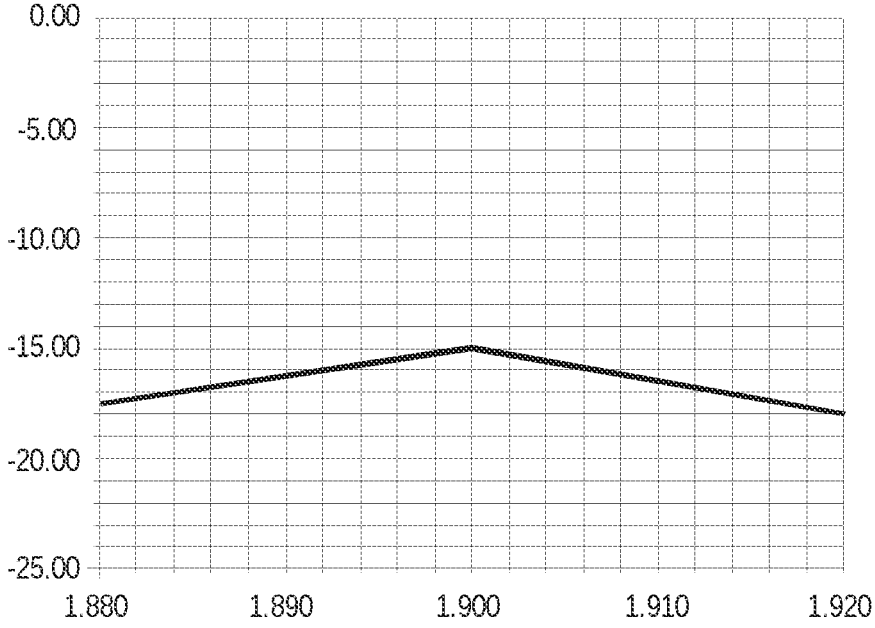
Figure 5C:
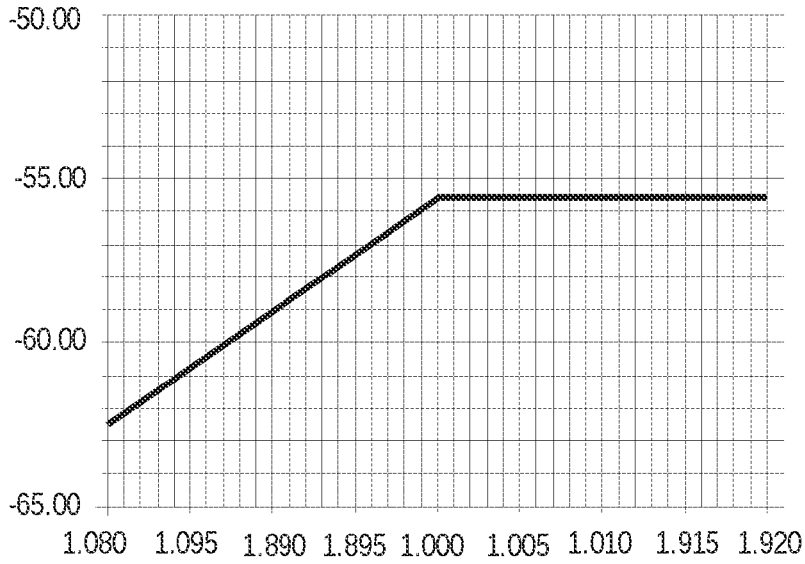

FIGS. 5A-5C illustrate return loss and isolation parameters for the dual polarized waveguide slot array 100. FIG. 5A illustrates the return loss (relative to 50 ohms) of the input into the first waveguide 120 over the frequency range of 1.88-1.920 GHz, with a maximum S11 being less than −15 dB. FIG. 5B illustrates the output return loss (relative to 50 ohms) of the output of the second waveguide 160 over the frequency range of 1.88-1.920 GHz, with a maximum S33 being less than −15 dB. FIG. 5C illustrates the cross-polarization isolation between the first and second waveguides 120 and 160 over the frequency range of 1.88-1.920 GHz, with a maximum S13 being less than −55 dB. As can be seen from these performance graphs, the dual polarized waveguide slot array provides near omni-directional coverage with good input and output matching with very little cross-polarization leakage.

Figure 6A:
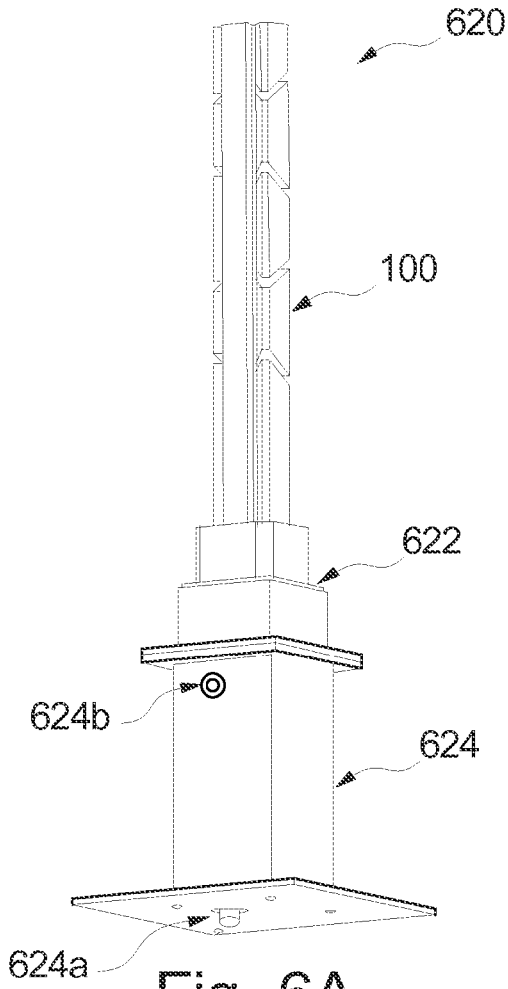
FIG. 6A illustrates an exemplary dual linear polarized antenna in accordance with one embodiment of the present invention.

FIG. 6A illustrates a dual linear polarized antenna 620 which incorporates the afore-described array 100 in accordance with one embodiment of the present invention. The dual linear polarize antenna 620 includes the array 100, a ridge waveguide to square waveguide transformer 622 and a square waveguide to coaxial input adapter 624. The transformer 622 is coupled to each of the first and second waveguides, e.g., the cross section of the bottom portion of the array 100 is coupled to the transformer 622 to form a transition thereto. The adapter 624 includes a horizontal signal port 624*a* for receiving or outputting a horizontally-polarized signal, and a vertical signal port 624*b* for receiving or output a vertically-polarized signal. The transformer 622 and adapter 624 are conventional components or can be manufactured through conventional techniques, such as Electrical Discharge Machining (EDM) or die casting. An exemplary embodiment of the ridge waveguide to square waveguide transformer 622 is shown in FIGS. 6D and 6E. An exemplary embodiment of the square waveguide to coaxial input adapter 624 is shown in FIGS. 6F and 6G.

Figure 6B:
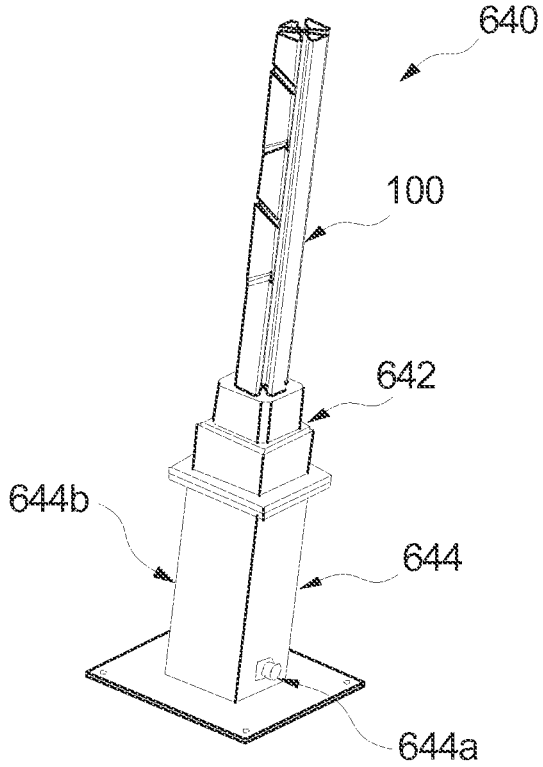
FIG. 6B illustrates an exemplary dual circular polarized antenna in accordance with one embodiment of the present invention.

FIG. 6B illustrates an exemplary dual circular polarized antenna 640 which incorporates the afore-described array 100 in accordance with one embodiment of the present invention. The dual circular polarized antenna 640 includes the array 100, a ridge waveguide to square waveguide transformer 642 and a septum polarizer 644. The septum polarizer 644 includes a RHCP port 644*a* for receiving or outputting a right-hand circularly polarized signal, and a LHCP signal port (oppositely-located on the septum polarizer 644) 644*b* for receiving or outputting a left-hand circularly polarized signal. An exemplary embodiment of the ridge waveguide to square waveguide transformer 622 is shown in FIGS. 6D and 6E. An exemplary embodiment of the septum polarizer 644 is shown in FIGS. 6H and 6I.

Figure 6C:
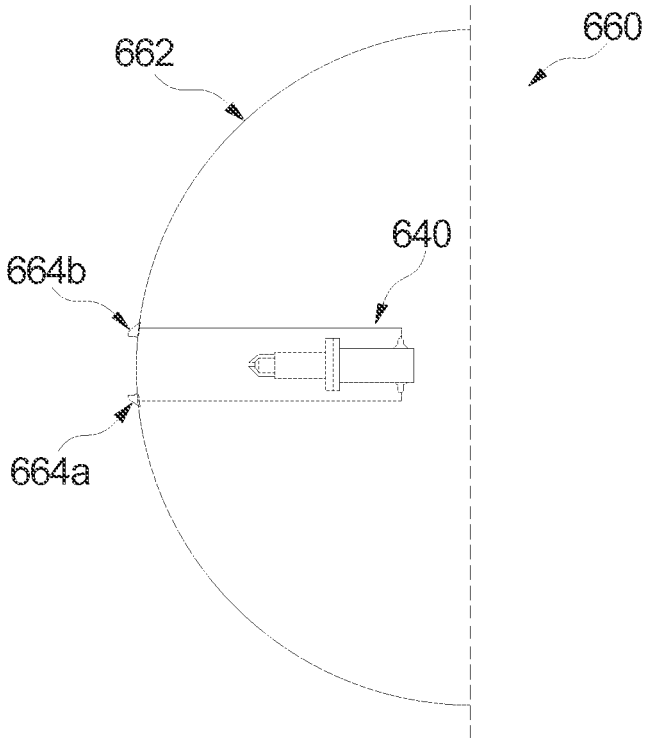
FIG. 6C illustrates an exemplary reflector antenna in accordance with one embodiment of the present invention.
Figure 6D:
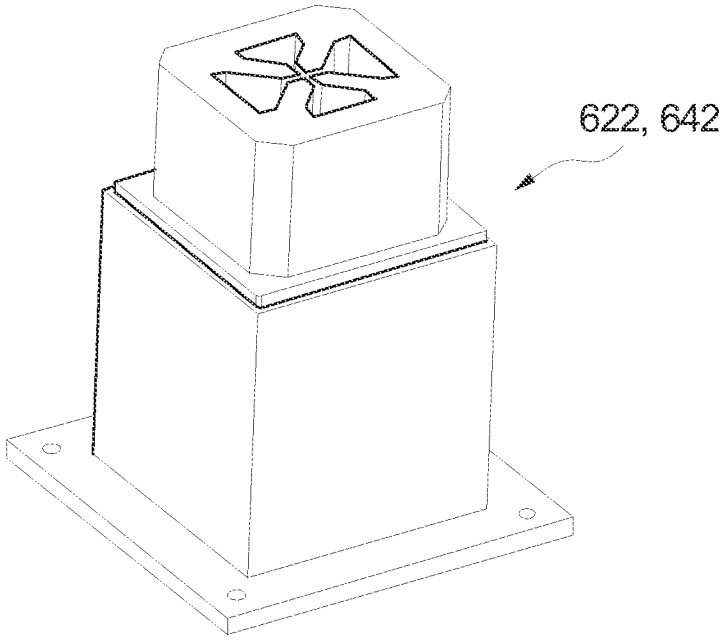
FIGS. 6D and 6E illustrate views of an exemplary ridge waveguide to square waveguide transformer in accordance with the invention.
Figure 6E:
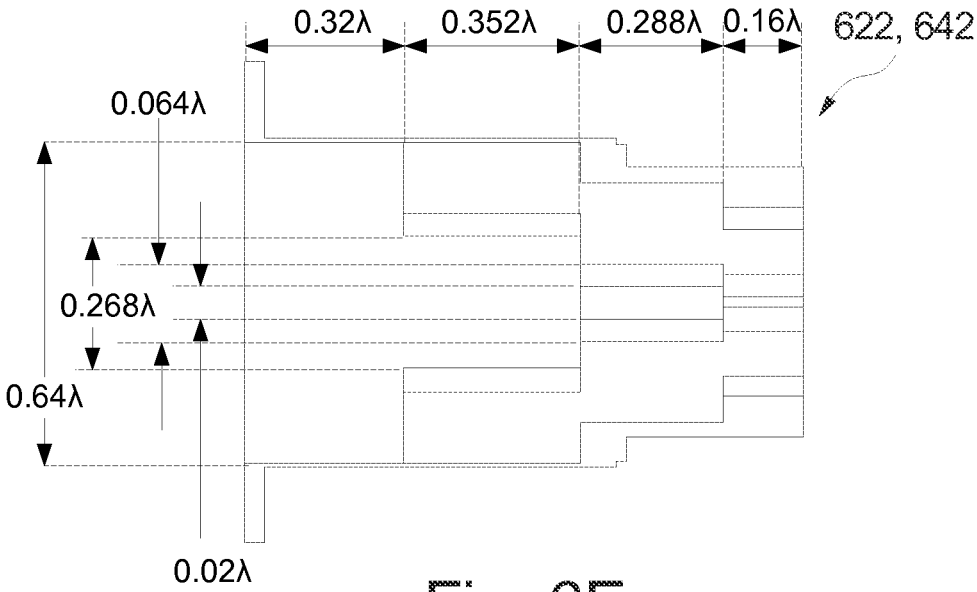
Figure 6F:
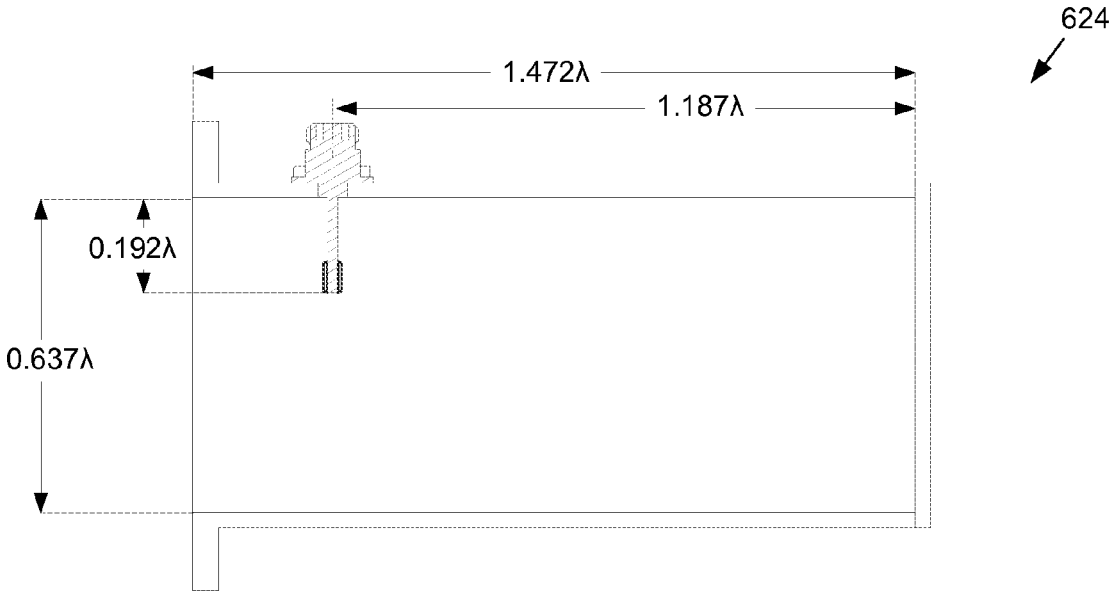
FIGS. 6F and 6G illustrate views of a square waveguide to coaxial input adapter in accordance with the invention.
Figure 6G:
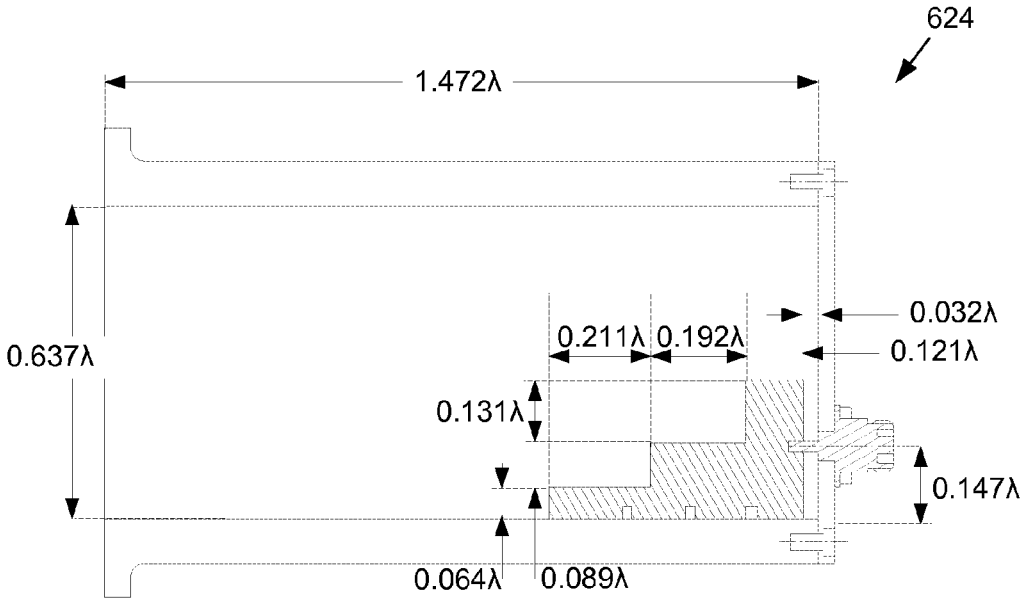
Figure 6H:
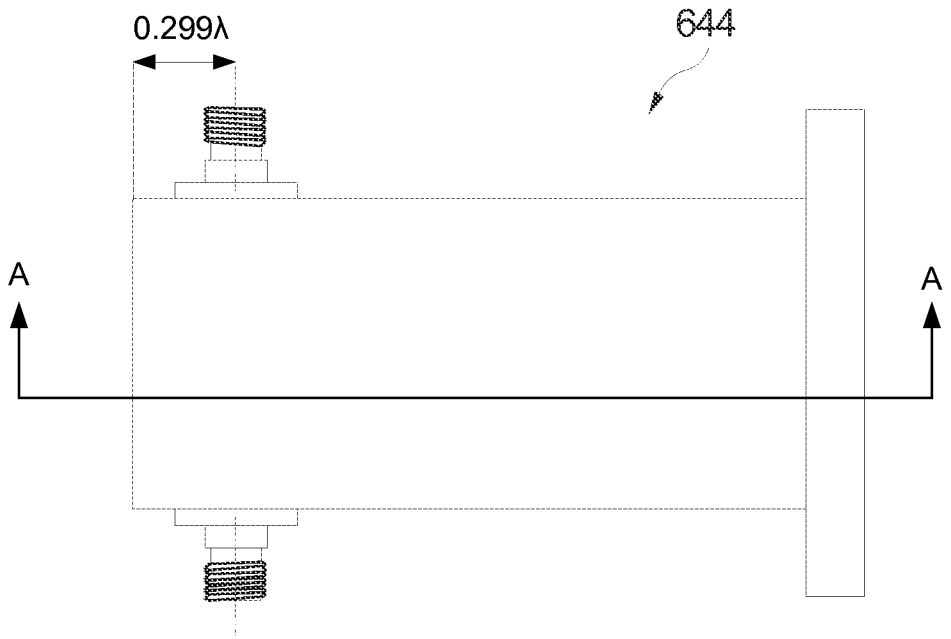
FIGS. 6H and 6I illustrate views of a septum polarizer in accordance with the invention.
Figure 6I:
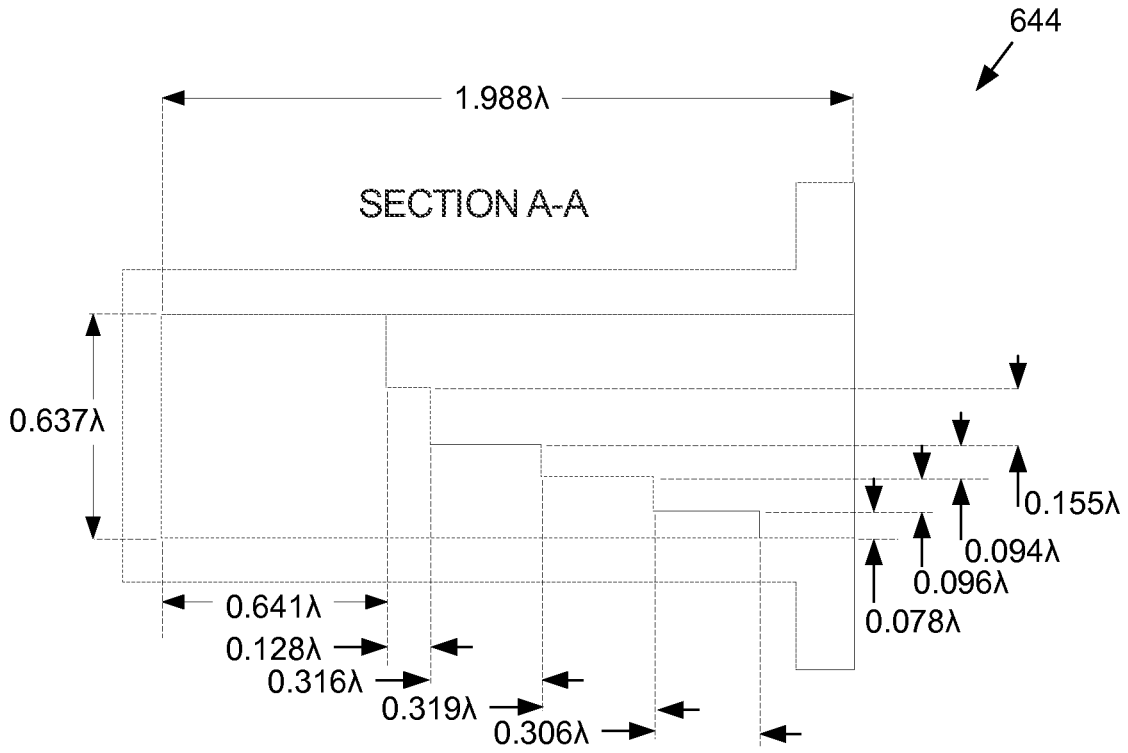
Figure 7A:
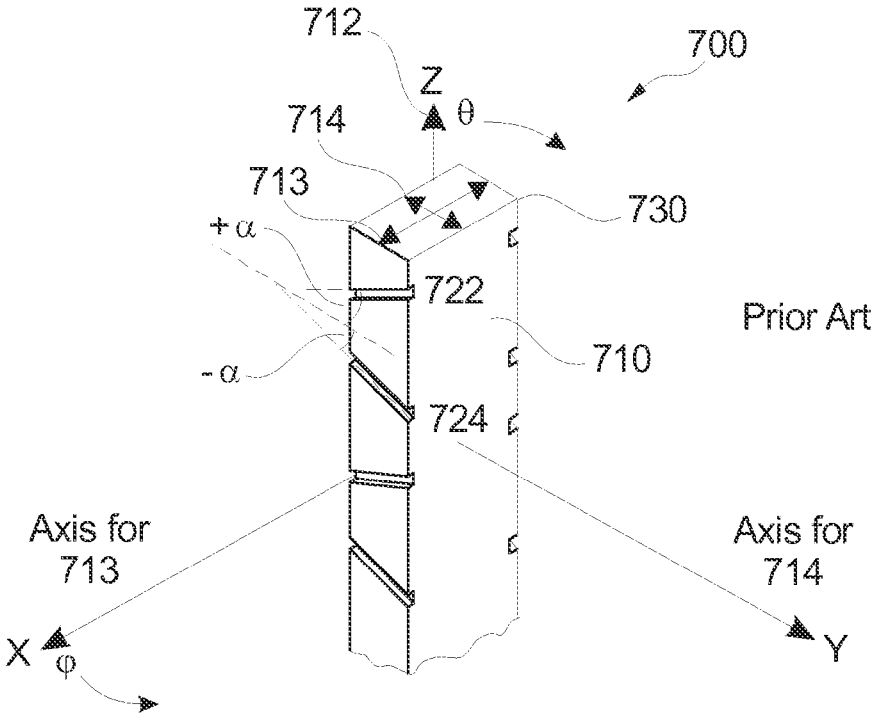
FIG. 7A illustrates a conventional vertically-polarized waveguide slot array as known in the art.
Figure 7B:
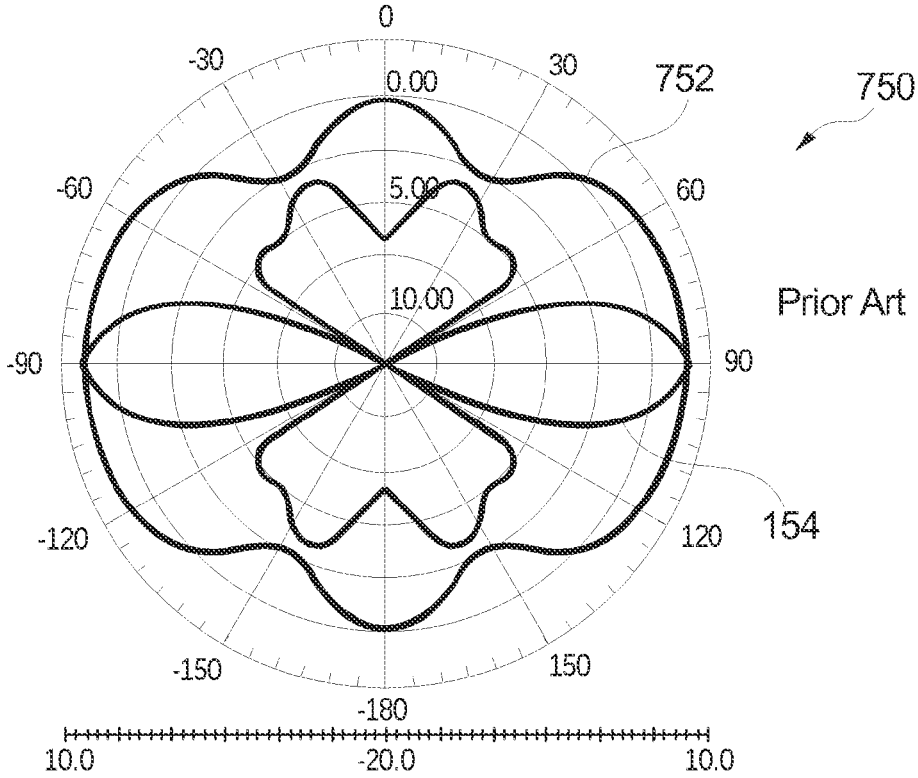
FIG. 7B illustrates a typical elevation and azimuth radiation pattern for the vertically-polarized waveguide slot array of FIG. 7A.
Figure 8A:
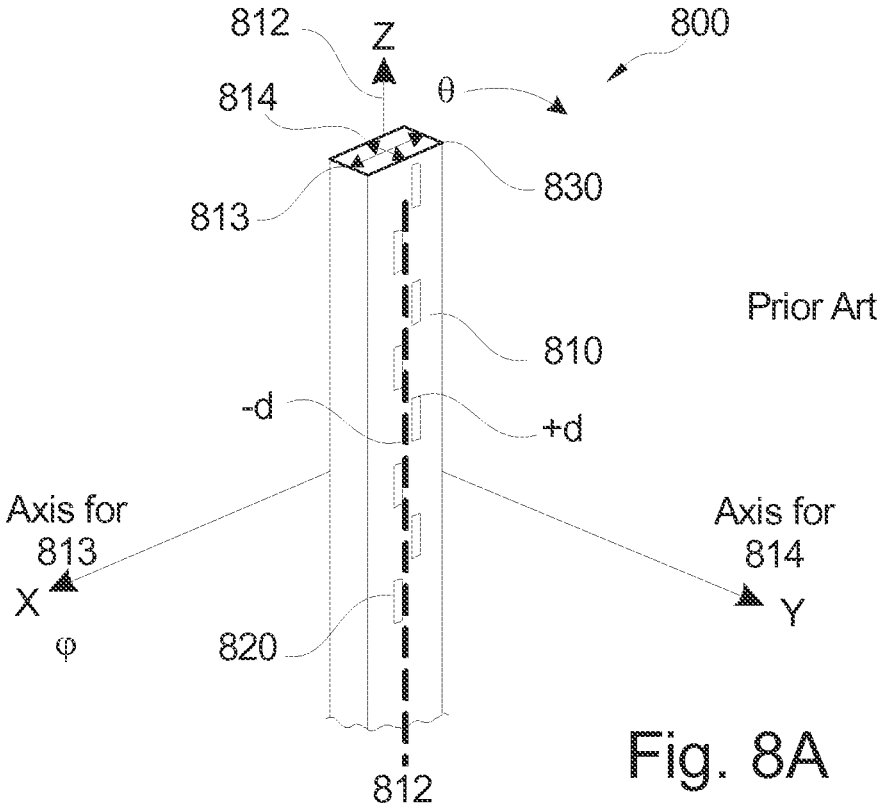
FIG. 8A illustrates a conventional horizontally-polarized waveguide slot array as known in the art.
Figure 8B:
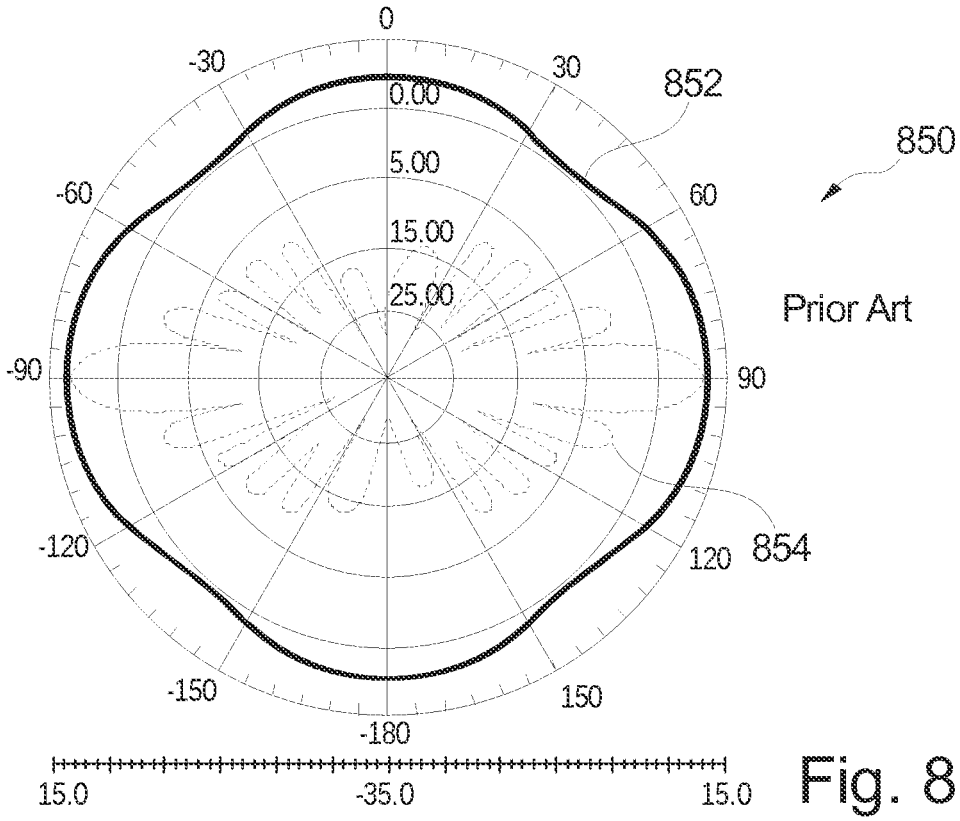
FIG. 8B illustrates a typical elevation and azimuth radiation pattern for the horizontally-polarized waveguide slot array of FIG. 8A.

FIG. 6C illustrates an exemplary reflector antenna 660 which incorporates the afore-described array 100 in accordance with one embodiment of the present invention. The reflector antenna 660 includes the dual circular polarized antenna 640 shown in FIG. 6B illuminating or receiving a signal from a reflector dish 662. Respective right- and left-hand circularly polarized signals are input/output to the antenna 660 via ports 664*a* and 664*b*. The reflector dish 662 may be a conventional component, or can be manufactured using a signal-reflective material, such as aluminum.

FIGS. 6D and 6E illustrate views of exemplary ridge waveguide to square waveguide transformers 622 and 642, respectively, in accordance with the invention. FIGS. 6F and 6G illustrate views of a square waveguide to coaxial input adapter 624 in accordance with the invention. FIGS. 6H and 6I illustrate views of a septum polarizer 644 in accordance with the invention. The adapter 624 and polarizer 644 represent an alternative embodiment of the feed structures shown in FIGS. 2A and 2B, and may provide advantages when it is difficult to manufacture the coaxial probes shown in FIGS. 2A and 2B to be of substantially equal lengths (e.g., +/−5% of each other).

The dual polarized waveguide slot array 100 and incorporating antennae 620, 640 and 660 can be employed in several applications. For example, each can be used as a diversity antenna in which the first and second waveguide sections 120 and 160 of the array 100 operate at the same frequency, or at different frequencies. In a specific embodiment, the array 100 and its corresponding antenna 620, 640 and 660 are implemented in a 1.8 GHz GSM system, a 2.2 GHz WiFi System, or a 3.5 GHz WiMax system, providing polarization diversity per antenna for each system.

As readily appreciated by those skilled in the art, the described processes and operations may be implemented in hardware, software, firmware or a combination of these implementations as appropriate. In addition, some or all of the described processes and operations may be implemented as computer readable instruction code resident on a computer readable medium, the instruction code operable to control a computer of other such programmable device to carry out the intended functions. The computer readable medium on which the instruction code resides may take various forms, for example, a removable disk, volatile or non-volatile memory, etc.

The terms "a" or "an" are used to refer to one, or more than one feature described thereby. Furthermore, the term "coupled" or "connected" refers to features which are in communication with each other (electrically, mechanically, thermally, as the case may be), either directly, or via one or more intervening structures or substances. The sequence of operations and actions referred to in method flowcharts are exemplary, and the operations and actions may be conducted in a different sequence, as well as two or more of the operations and actions conducted concurrently. Reference indicia (if any) included in the claims serve to refer to one exemplary embodiment of a claimed feature, and the claimed feature is not limited to the particular embodiment referred to by the reference indicia. The scope of the claimed feature shall be that defined by the claim wording as if the reference indicia were absent therefrom. All publications, patents, and other documents referred to herein are incorporated by reference in their entirety. To the extent of any inconsistent usage between any such incorporated document and this document, usage in this document shall control.

The foregoing exemplary embodiments of the invention have been described in sufficient detail to enable one skilled in the art to practice the invention, and it is to be understood that the embodiments may be combined. The described embodiments were chosen in order to best explain the principles of the invention and its practical application to thereby enable others skilled in the art to best utilize the invention in various embodiments and with various modifications as are suited to the particular use contemplated. It is intended that the scope of the invention be defined solely by the claims appended hereto.

What is claimed is:

1. A dual polarized waveguide slot array, comprising:

a first waveguide having major and minor cross-sectional axes and extending along a common longitudinal axis, the first waveguide comprising a plurality of slots disposed thereon for radiating or receiving signals of a first polarization, the first waveguide comprising:

two outer wavequide sections laterally-opposed along the major cross-section axis; and an inner waveguide section coupled between the two outer waveguide sections, wherein an edge slot is disposed in each of the two outer wavequide sections; and a second waveguide coupled to the first waveguide, the second waveguide extending along the common longitudinal axis and having major and minor cross-sectional axes, the major cross-sectional axis of the second waveguide oriented substantially orthogonally to the cross-sectional axis of the first waveguide, the second waveguide comprising a plurality of slots disposed thereon for radiating or receiving signals of a second polarization substantially orthogonal to the first polarization.

2. The dual polarized waveguide slot array of claim 1, wherein the edge slot disposed on each of the two outer waveguide sections extend around a majority of the periphery of each of the two outer waveguide sections.

3. The dual polarized waveguide slot array of claim 2, wherein a plurality of edge slots is disposed in each of the two outer waveguide sections, and wherein adjacent edge slots are complementary angled relative to the axis of the minor cross-section axis of the first waveguide.

4. The dual polarized slot array of claim 1, wherein the plurality of slots disposed on the first waveguide are operable for radiating or receiving a horizontally polarized signal, and wherein the plurality of slots disposed on the second waveguide are operable for radiating or receiving a vertically polarized signal.

5. The dual polarized slot array of claim 1, wherein the plurality of slots disposed on the first waveguide are operable for radiating or receiving a right hand circularly polarized signal, and wherein the plurality of slots disposed on the second waveguide are operable for radiating or receiving a left hand circularly polarized signal.

6. A dual polarized wavequide slot array, comprising:

a first wavequide having major and minor cross-sectional axes and extending along a common longitudinal axis, the first waveguide comprising a plurality of slots disposed thereon for radiating or receiving signals of a first polarization; and a second wavequide coupled to the first wavequide, the second wavequide extending along the common longitudinal axis and having major and minor cross-sectional axes, the major cross-sectional axis of the second waveguide oriented substantially orthogonally to the cross-sectional axis of the first waveguide, the second wavequide comprising:

a plurality of slots disposed thereon for radiating or receiving signals of a second polarization substantially orthogonal to the first polarization, two outer waveguide sections laterally-opposed along the major cross-section axis; and an inner waveguide section coupled between the two outer waveguide sections, wherein a plurality of slots is disposed in the inner waveguide section.

7. The dual polarized waveguide slot array of claim 6, wherein each of the plurality of slots extend longitudinally along the common axis.

8. The dual polarized waveguide slot array of claim 7, wherein the plurality of slots comprise adjacent slots which are oppositely offset a predefined distance from a center line of the major cross-sectional axis.

9. The dual polarized slot array of claim 8, wherein adjacent longitudinal slots are disposed into the inner waveguide section at predefined complementary angles relative to the minor cross-section axis of the second waveguide.

10. A dual polarized antenna, comprising:

a dual polarized waveguide slot array, comprising:

a first waveguide having major and minor cross-sectional axes and extending along a common longitudinal axis, the first waveguide comprising a plurality of slots disposed thereon for radiating or receiving signals of a horizontal polarization; and a second waveguide coupled to the first waveguide, the second waveguide extending along the common longitudinal axis and having major and minor cross-sectional axes, the major cross-sectional axis of the second waveguide oriented substantially orthogonally to the cross-sectional axis of the first waveguide, the second waveguide comprising a plurality of slots disposed thereon for radiating or receiving signals of a vertical polarization;

a ridge waveguide to square waveguide transformer coupled to each of the first and second waveguides; and a square waveguide to coaxial input adapter coupled to the ridge waveguide, the square waveguide including a first port for receiving or outputting a horizontally-polarized signal, and a second port for receiving or output a vertically-polarized signal.

11. The dual polarized antenna of claim 10, wherein the first waveguide comprises:

two outer waveguide sections laterally-opposed along the major cross-section axis; and an inner waveguide section coupled between the two outer waveguide sections, wherein an edge slot is disposed in each of the two outer waveguide sections.

12. The dual polarized antenna of claim 11, wherein the edge slot disposed on each of the two outer waveguide sections extend around a majority of the periphery of each of the two outer waveguide sections.

13. The dual polarized antenna of claim 12, wherein a plurality of edge slots is disposed in each of the two outer waveguide sections, and wherein adjacent edge slots are complementary angled relative to the axis of the minor cross-section axis of the first waveguide.

14. The dual polarized antenna of claim 10, wherein the second waveguide comprises:

two outer waveguide sections laterally-opposed along the major cross-section axis; and an inner waveguide section coupled between the two outer waveguide sections, wherein a plurality of slots is disposed in the inner waveguide section.

15. The dual polarized antenna of claim 14, wherein each of the plurality of slots extend longitudinally along the common axis.

16. The dual polarized antenna of claim 15, wherein the plurality of slots comprise adjacent slots which are oppositely offset a predefined distance from a center line of the major cross-sectional axis.

17. The dual polarized antenna of claim 16, wherein adjacent longitudinal slots are disposed into the inner waveguide section at predefined complementary angles relative to the minor cross-section axis of the second waveguide.

18. The dual polarized antenna of claim 10, wherein the plurality of slots disposed on the first waveguide are operable for radiating or receiving a horizontally polarized signal, and wherein the plurality of slots disposed on the second waveguide are operable for radiating or receiving a vertically polarized signal.

19. The dual polarized antenna of claim 10, wherein the plurality of slots disposed on the first waveguide are operable for radiating or receiving a right hand circularly polarized signal, and wherein the plurality of slots disposed on the second waveguide are operable for radiating or receiving a left hand circularly polarized signal.

20. A reflector antenna, comprising:

a reflector dish, and a dual polarized waveguide slot array coupled to receive signals from or to transmit signals to the reflector dish, the dual polarized waveguide slot array, comprising:

a first waveguide having major and minor cross-sectional axes and extending along a common longitudinal axis, the first waveguide comprising a plurality of slots disposed thereon for radiating or receiving signals of a right-hand circular polarization, the first wavequide comprising:

two outer waveguide sections laterally-opposed along the major cross-section axis; and an inner wavequide section coupled between the two outer wavequide sections, wherein an edge slot is disposed in each of the two outer wavequide sections; and a second waveguide coupled to the first waveguide, the second waveguide extending along the common longitudinal axis and having major and minor cross-sectional axes, the major cross-sectional axis of the second waveguide oriented substantially orthogonally to the cross-sectional axis of the first waveguide, the second waveguide comprising a plurality of slots disposed thereon for radiating or receiving signals of a left-hand circular polarization.

21. The reflector antenna of claim 20, wherein the edge slot disposed on each of the two outer waveguide sections extend around a majority of the periphery of each of the two outer waveguide sections.

22. The reflector antenna of claim 21, wherein a plurality of edge slots is disposed in each of the two outer waveguide sections, and wherein adjacent edge slots are complementary angled relative to the axis of the minor cross-section axis of the first waveguide.

23. A reflector antenna, comprising:

a reflector dish, and a dual polarized wavequide slot array coupled to receive signals from or to transmit signals to the reflector dish, the dual polarized wavequide slot array, comprising:

a first waveguide having major and minor cross-sectional axes and extending along a common longitudinal axis, the first wavequide comprising a plurality of slots disposed thereon for radiating or receiving signals of a right-hand circular polarization; and a second waveguide coupled to the first waveguide, the second waveguide extending along the common longitudinal axis and having major and minor cross-sectional axes, the major cross-sectional axis of the second wavequide oriented substantially orthogonally to the cross-sectional axis of the first wavequide, the second waveguide comprising:

a plurality of slots disposed thereon for radiating or receiving signals of a left-hand circular polarization, two outer waveguide sections laterally-opposed along the major cross-section axis; and an inner waveguide section coupled between the two outer waveguide sections, wherein a plurality of slots is disposed in the inner waveguide section.

24. The reflector antenna of claim 23, wherein each of the plurality of slots extend longitudinally along the common axis.

25. The reflector antenna of claim 24, wherein the plurality of slots comprise adjacent slots which are oppositely offset a predefined distance from a center line of the major cross-sectional axis.

26. The reflector antenna of claim 25, wherein adjacent longitudinal slots are disposed into the inner waveguide section at predefined complementary angles relative to the minor cross-section axis of the second waveguide.

* * * * *